US011946671B2

(12) United States Patent
Huang et al.

(10) Patent No.: US 11,946,671 B2
(45) Date of Patent: Apr. 2, 2024

(54) HEAT PUMP SYSTEM AND CONTROL METHOD

(71) Applicant: ECOER INC., Fairfax, VA (US)

(72) Inventors: Zhicheng Huang, Beijing (CN); Zhonghui Li, Beijing (CN)

( * ) Notice: Subject to any disclaimer, the term of this patent is extended or adjusted under 35 U.S.C. 154(b) by 45 days.

(21) Appl. No.: 16/767,855

(22) PCT Filed: Jul. 15, 2019

(86) PCT No.: PCT/US2019/041785
§ 371 (c)(1),
(2) Date: May 28, 2020

(87) PCT Pub. No.: WO2021/010956
PCT Pub. Date: Jan. 21, 2021

(65) Prior Publication Data

US 2022/0074630 A1 Mar. 10, 2022

(51) Int. Cl.
*F25B 13/00* (2006.01)

(52) U.S. Cl.
CPC ..... *F25B 13/00* (2013.01); *F25B 2500/19* (2013.01); *F25B 2500/26* (2013.01); *F25B 2500/27* (2013.01); *F25B 2700/2106* (2013.01)

(58) Field of Classification Search
CPC .. F25B 13/00; F25B 2500/19; F25B 2500/26; F25B 2500/27; F25B 2700/2106
See application file for complete search history.

(56) References Cited

U.S. PATENT DOCUMENTS

| | | | | |
|---|---|---|---|---|
| 7,895,003 | B2 * | 2/2011 | Caillat | F01C 20/28 73/865.8 |
| 7,979,164 | B2 * | 7/2011 | Garozzo | F24F 11/30 236/1 C |
| 9,678,486 | B2 * | 6/2017 | Grohman | F24F 11/30 |
| 2007/0012052 | A1 * | 1/2007 | Butler | F25B 49/02 62/181 |
| 2007/0130974 | A1 * | 6/2007 | Gatlin | F25D 21/006 62/227 |
| 2014/0167970 | A1 * | 6/2014 | Gado | F25B 49/005 340/614 |
| 2017/0115025 | A1 * | 4/2017 | Mowris | F24F 11/77 |
| 2019/0258237 | A1 * | 8/2019 | Buda | G05B 23/0243 |

FOREIGN PATENT DOCUMENTS

| | | | | |
|---|---|---|---|---|
| CA | 3087774 | A1 * | 1/2021 | F24F 11/38 |
| KR | 20150075897 | A * | 7/2015 | |
| WO | WO-2010104709 | A2 * | 9/2010 | F25B 13/00 |

* cited by examiner

*Primary Examiner* — Kun Kai Ma
(74) *Attorney, Agent, or Firm* — John Ye

(57) ABSTRACT

The present disclosure relates to the field of air conditioning technology. In particular, it involves a heat pump system and control method.

3 Claims, 3 Drawing Sheets

HEAT PUMP SYSTEM AND CONTROL METHOD

BACKGROUND OF THE DISCLOSURE

The disclosure below will assume common knowledge of air conditioning and heat pump as well as their heat exchange principle in terms of achieving cooling and heating.

With the energy crisis and people's awareness of environmental protection becoming more and more prominent, the heat pump system has been widely recognized and applied worldwide due to its advantages in energy saving, environmental protection and comfort. At present, heat pump air conditioning systems are gradually replacing cooling mode air conditioning systems or air-conditioning systems that combine cooling and gas-fired furnaces. If the existing cooling air-conditioning system is to be modified and the cooling air-conditioning system is converted into a heat pump type of air-conditioning system, the outdoor unit need to be replaced. But if the line between the outdoor unit and the indoor unit needs to be replaced, it takes a lot of money. And even worse, due of the characteristics of the building itself, these lines might not be replaceable. In the traditional cooling air-conditioning system, the outdoor unit has only two states of function: shutdown and cooling. The thermostat of the air-conditioning system can control the outdoor unit only by issuing a stop command or a cooling command, so there are only two signal lines in the conventional 24 VAC system. The signal lines, one of which is the Y signal line, is the compressor control signal. The compressor starts to cool when the Y line outputs a 24 VAC signal. The other C signal line acts as the common end.

The heat pump air conditioning system has three states: shutdown, cooling and heating. Obviously, in the conventional 24 VAC system, the two signal lines Y and C cannot satisfy the three state control. The currently widely used solution is to add an O signal line or a B signal line in addition to the Y and C signal lines for controlling the four-way valve to distinguish between cooling and heating commands. When the Y line outputs a 24 VAC signal, the system cools when the O outputs a 24 VAC signal, and the system heats when the O line does not output a 24 VAC signal. The B signal is reversed of O signal. When the B line outputs a 24 VAC signal, the system heats up, and when the B line does not output a 24 VAC signal, the system cools. This type of transmission requires a modification of the wiring method of the original air conditioning system, and the cost is high. Another communication scheme is to transmit signals between the thermostat and the outdoor unit through a network such as RS485, CAN bus or wireless. But the wireless transmission scheme needs to add a wireless module to the thermostat and the outdoor unit, and the transmission signal is easily affected by distance and obstacles.

It can be seen that when transforming the old cooling air-conditioning system into a heat pump type air-conditioning system, a method of using the original Y/C signal line to achieve the three state control of the heat pump system for cooling, heating and shutdown is needed, thereby avoiding the need for transformation or rerouting the signal lines.

SUMMARY OF THE DISCLOSURE

In order to solve the above technical problem, the present invention provides a heat pump type air conditioning system including an outdoor unit, an indoor unit, and a thermostat.

The outdoor unit includes a main controller unit, a sensor acquisition unit, and a data storage unit, driving unit, compressor, fan, four-way valve, electronic expansion valve, and interface circuit.

The main controller unit calculates various parameters required for system operation to interpret the instruction received from the thermostat, based on the information collected by each sensor. It then sends the instruction to the driving unit.

The sensor acquisition unit is configured to acquire data collected by the outdoor unit sensors, including ambient temperature, outdoor unit liquid line outlet temperature, compressor return air temperature, compressor outlet temperature, compressor high and low pressure, circuit board radiator temperature, and the like.

The data storage unit is used for storing various data of the system operation, including commands received by the system, various sensor data, compressor speed, fan speed, electronic expansion valve opening, and the like.

The driving unit is configured to receive an instruction issued by the main controller, and is converted into a driving signal to drive the mechanical component to execute the instruction, and to protect the driving circuit and the mechanical components according to the actual operating state. The mechanical components include a compressor, a fan, a four-way valve, and an electronic expansion valve, etc.

The disclosure also provides a control method of a heat pump type air conditioning system. The control method comprising:

Phase 1: In a stop state, the thermostat does not output a Y signal, when the thermostat receives the user's cooling or heating demand. The thermostat delivers a specific Y signal to the outdoor unit.

Phase 2: When the outdoor unit is in the standby state before detecting the Y signal described in phase 1, the outdoor unit calls the cooling or heating program according to the Y signal characteristic, and simultaneously records the outdoor unit running state and jumps to Phase 4.

Phase 3: When the outdoor unit is in the repowered state after power-off, that is, the Y signal type that cannot be detected in this case, the main control logic unit 100 is set to first determine the following conditions:

a. whether the Y signal of the cooling demand had been received in the prior operation history data, and whether the outdoor unit was performing cooling;

b. whether the operation mode of the outdoor unit before the power failure is in cooling mode;

c. Whether the difference between the outdoor ambient temperature T currently detected by the outdoor unit and the outdoor ambient temperature T' recorded before the power-off is within a threshold ±A, that is, whether $-A<(T-T')<+A$ is satisfied. When the above conditions are satisfied, the outdoor unit executes the cooling command, otherwise the heating command is executed.

In Phase 4, the outdoor unit controls its internal outdoor unit interface circuit, sensor acquisition unit, data storage unit, drive unit, compressor, fan, four-way valve, electronic expansion valve to perform cooling or heating procedures, and records historical data in real time, including parameters such as temperature, pressure, and command status.

DETAILED DESCRIPTION OF THE DISCLOSURE

First Embodiment

Figure 1:
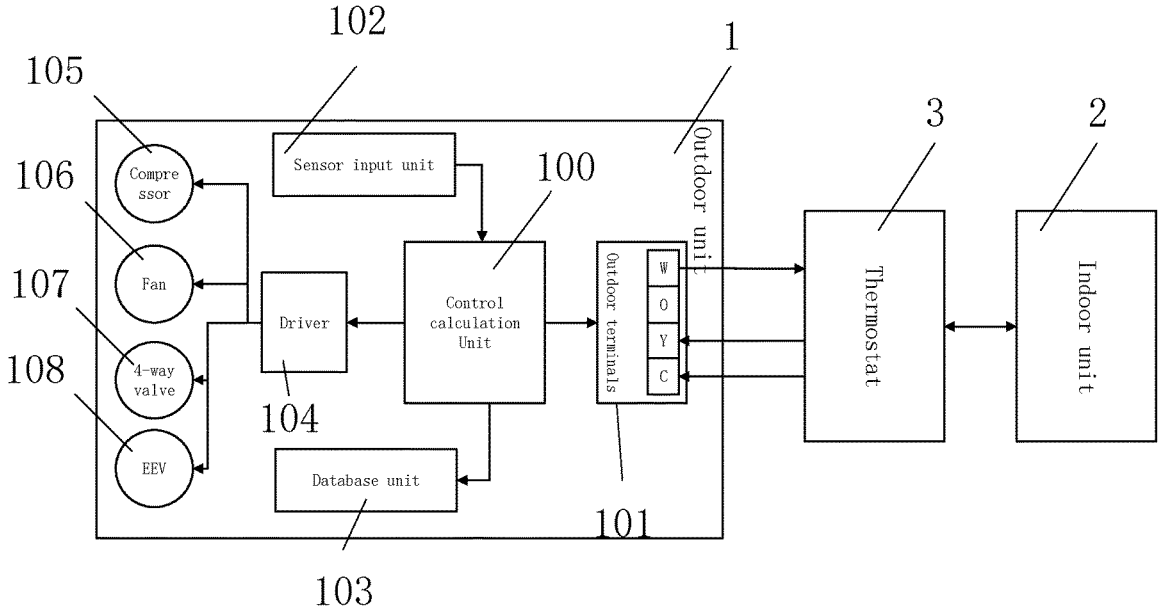
FIG. 1 shows a heat pump system configuration, according to an embodiment of this disclosure.

FIG. 1 is the heat pump configuration diagram of the first embodiment. As shown in FIG. 1, the air conditioning system in this embodiment includes at least an outdoor unit 1, an indoor unit 2, and a thermostat 3. The indoor unit 1 includes a main control logic unit 100, an outdoor unit interface circuit 101, a sensor collection unit 102, a data storage unit 103, a driving unit 104, a compressor 105, a fan 106, a four-way valve 107, and an electronic expansion valve 108. The main controller operation unit 100 calculates various parameters required for the system operation according to the instruction of the thermostat 3 and the information collected by the sensor acquisition unit 102, and delivers the instruction to the driving unit 104. The sensor collection unit 102 is configured to acquire data parameters including an outdoor ambient temperature, an outdoor unit liquid pipe outlet temperature, a compressor return air temperature, a compressor exhaust temperature, a compressor high and low pressure, and a board heat sink temperature. The data storage unit 103 is used to store various data of the system operation, including commands received by the system, various sensor data, compressor speed, fan speed, electronic expansion valve opening, and the like. The driving unit 104 is configured to receive an instruction issued by the main controller computing unit 100, and convert it into a driving signal to drive the mechanical component to execute the instruction, and protect the driving circuit and the mechanical component according to the actual operating state. The mechanical components include a compressor 105, a blower 106, a four-way valve 107, an electronic expansion valve 108, and the like.

Figure 2:
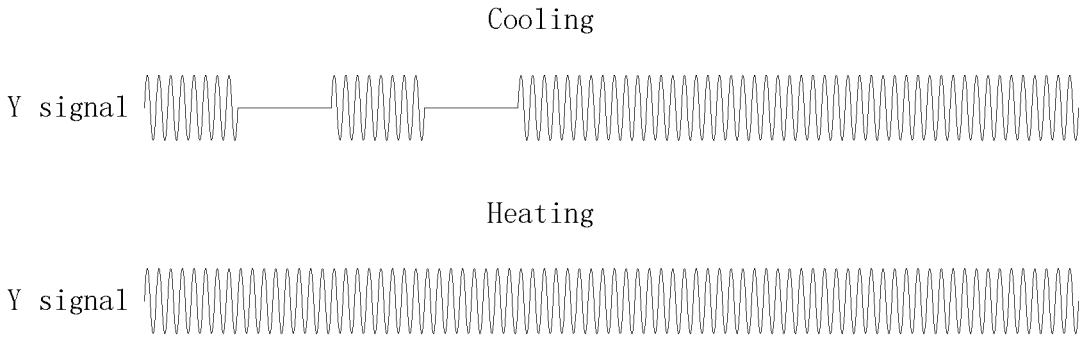
FIG. 2 shows a system control method for cooling and heating modes under the Y signal diagram according to an embodiment of this disclosure

FIG. 2 is a schematic diagram of the Y signal in the present disclosure. In the cooling mode, the Y signal first outputs a 24 VAC signal for 2 seconds, then stops the output for 2 seconds. It then outputs the 24 VAC signal again for 2 seconds, then stops the output again and remains for 2 seconds. Finally it keeps outputting 24 VAC signal. That is, after outputting the 24 VAC signal for 2 seconds, the output is stopped for 2 seconds as a cycle. In the cooling mode, the Y signal first outputs two cycles of the signal, and then the 24 VAC signal is continuously output. In the heating mode, the Y signal is continuously output from the beginning with the 24 VAC signal.

Figure 3:
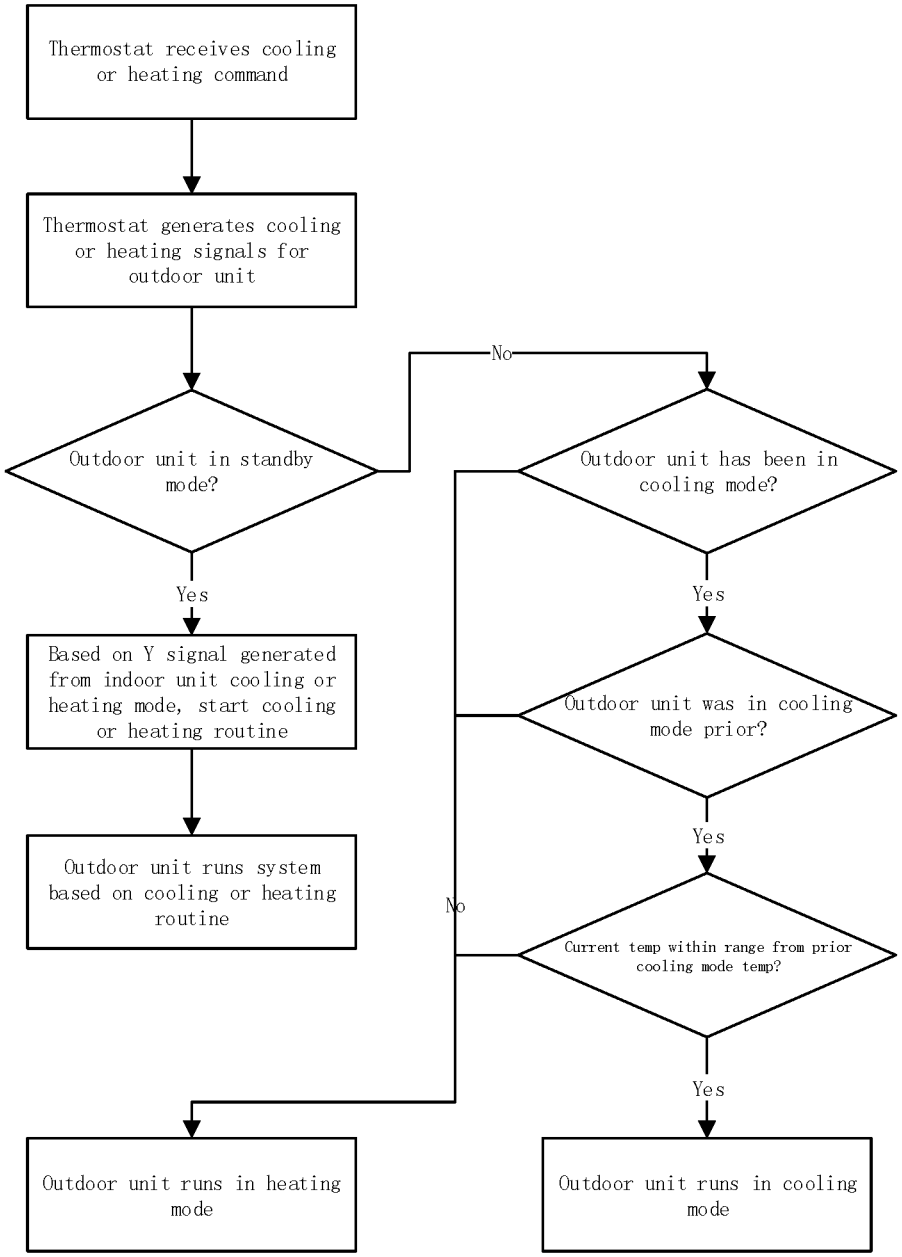
FIG. 3 shows a heat pump system and control method according to an embodiment of this disclosure.

FIG. 3 is a schematic view showing the logic of the control method of the heat pump type air conditioning system used in the embodiment. According to the above, for the Y signal for distinguishing between the cooling mode and the heating mode, the control method for controlling the heat pump type air conditioning system in the present embodiment is:

Step 1: In the stop state, the thermostat does not output the Y signal. When the thermostat receives the user's cooling or heating demand, the thermostat sends the Y signal to the outdoor unit. In the case of cooling demand, the Y signal transmitted by the thermostat is: first output 24 VAC signal for 2 seconds, then stop output for 2 seconds, the output 24 VAC signal again for 2 seconds, then stop output for 2 seconds. Finally, the output of the 24 VAC signal is maintained. That is, after outputting the 24 VAC signal for 2 seconds, the output is stopped for 2 seconds as a cycle. In the cooling mode, the Y signal first outputs the signal of 2 cycles and then keeps the 24 VAC signal for continuous output. But in the case of heating demand, the thermostat transmits the Y signal continuously as output from the initial 24 VAC signal.

Step 2: When the Y signal described in Step 1 is detected while the outdoor unit is in the standby state, the outdoor unit calls the cooling or heating program according to the Y signal characteristic, and simultaneously records the outdoor unit running state and jumps to Step 4.

Step 3: When the outdoor unit is in the power-off state after power-off, that is, in this case, the detected Y signal is continuously outputted as 24 VAC signal, and the Y signal type cannot be distinguished at this time; then the main control logic unit 100 is set. First determine the following conditions:

a. Whether the Y signal of the cooling demand has been received in the historical operation data of the outdoor unit, and the system has performed cooling;

b. Whether the operation mode of the outdoor unit before the power failure is in cooling mode;

c. Whether the difference between the outdoor ambient temperature T currently detected by the outdoor unit and the outdoor ambient temperature T' recorded before the power-off is within a threshold A, that is, whether $-A<(T-T')$ is satisfied. In this embodiment, the threshold value A is 6. But the value of A can be set according to the temperature difference of different seasons or the temperature difference between morning and evening, and the set value of A can be changed in different months.

When the above conditions are satisfied, the outdoor unit executes the cooling command, otherwise the heating command is executed.

In Step 4, the outdoor unit controls its internal outdoor unit interface circuit 101, sensor acquisition unit 102, data storage unit 103, driving unit 104, compressor 105, fan 106, four-way valve 107, and electronic expansion valve 108 to perform cooling or heating. Program and record historical data in real time, including parameters such as temperature, pressure, and command status.

The invention claimed is:

1. A heat pump type air conditioning system comprises an outdoor unit, an indoor unit, and a thermostat;

wherein the outdoor unit comprises a main controller, a sensor input unit, a database unit, a driver, a compressor, a fan, a four-way valve, an electronic expansion valve, and an interface circuit; and the thermostat is configured to send a conventional AC voltage output toggling on and off on one wire to the main controller; and the main controller is further configured from power-off to determine if the system needs to run in cooling mode or heating mode; and the main controller is configured to send an instruction for cooling or heating to the driver; and wherein the sensor input unit is configured to acquire data collected by outdoor unit sensors, including ambient temperature; and the database unit is configured to store various data of the system operation, including the instructions received by the main controller, timing, and the various sensor data; and the main controller is further configured to calculate various parameters required to interpret an instruction received from the thermostat whenever the outdoor unit is powered up; and wherein the main controller is further configured from power-off to determine if the system has run in cooling mode, and that the cooling mode was previously run before the power was cut, and whether the outdoor ambient temperature T' recorded before the power-off is within a threshold A from the current outdoor ambient temperature T, and when $-A<(T-T')$ is satisfied, send an instruction for cooling to the driver or send an instruction for heating when the conditions are not met.

2. A heat pump type air conditioning system control method comprising:

sending a conventional AC voltage output toggling on and off on one wire to outdoor main controller; and responding by the outdoor main controller from power-off to determine if the system needs to run in cooling mode or heating mode; and processing the cooling and heating instruction at the outdoor main controller; and sending an instruction for cooling or heating to a driver; and determining conditions at the outdoor main controller, from historic data on ambient temperature, system operation commands received by the system, timing data; and interpreting cooling and heating instruction whenever the outdoor unit is powered up; and determining from power-off if the system has run in cooling mode, and that the cooling mode was previously run before the power was cut, and whether the outdoor ambient temperature T' recorded before the power-off is within a threshold A from the current outdoor ambient temperature T, and when $-A<(T-T')$ is satisfied, sending an instruction for cooling to the driver, or sending an instruction for heating when the conditions are not met.

3. A non-transitory computer-readable medium having stored thereon a set of computer-executable instructions for causing a heat pump type air conditioning system to perform steps comprising:

sending a conventional AC voltage output toggling on and off on one wire to outdoor main controller; and responding by the outdoor main controller from power-off to determine if the system needs to run in cooling mode or heating mode; and processing the cooling and heating instruction at the outdoor main controller; and sending an instruction for cooling or heating to a driver; and determining conditions at the outdoor main controller, from historic data on ambient temperature, system operation commands received by the system, timing data; and interpreting cooling and heating instruction whenever an outdoor unit is powered up; and determining from power-off if the system has run in cooling mode, and that the cooling mode was previously run before the power was cut, and whether the outdoor ambient temperature T' recorded before the power-off is within a threshold A from the current outdoor ambient temperature T, and when $-A<(T-T')$ is satisfied, sending an instruction for cooling to the driver, or sending an instruction for heating when the conditions are not met.

* * * * *